US007540378B2

(12) United States Patent
Gallagher

(10) Patent No.: US 7,540,378 B2
(45) Date of Patent: Jun. 2, 2009

(54) CASE WITH SELECTIVELY ADJUSTABLE STORAGE PORTION

(75) Inventor: Kevin P. Gallagher, Boulder, CO (US)

(73) Assignee: Thule Organization Solutions, Inc., Longmont, CO (US)

( * ) Notice: Subject to any disclaimer, the term of this patent is extended or adjusted under 35 U.S.C. 154(b) by 155 days.

(21) Appl. No.: 11/279,986

(22) Filed: Apr. 17, 2006

(65) Prior Publication Data

US 2007/0241011 A1 Oct. 18, 2007

(51) Int. Cl.
*B65D 85/00* (2006.01)
*B65D 85/30* (2006.01)

(52) U.S. Cl. ..... 206/320; 206/521; 206/583; 206/594

(58) Field of Classification Search ..... 206/320, 206/521, 583, 591, 594, 305
See application file for complete search history.

(56) References Cited

U.S. PATENT DOCUMENTS

| | | | |
|---|---|---|---|
| 2,585,745 | A | 2/1952 | Crosby |
| D270,306 | S | 8/1983 | Stark |
| D270,872 | S | 10/1983 | Katz et al. |
| D280,266 | S | 8/1985 | Allen |
| D283,465 | S | 4/1986 | Allen |
| D292,747 | S | 11/1987 | Allen |
| 5,002,184 | A | 3/1991 | Lloyd |
| 5,010,988 | A | 4/1991 | Brown |
| D325,128 | S | 4/1992 | Cyr et al. |
| 5,217,119 | A | 6/1993 | Hollingsworth |
| D338,104 | S | 8/1993 | Lee |
| D338,108 | S | 8/1993 | Lee |
| D346,694 | S | 5/1994 | Cyr et al. |
| D346,901 | S | 5/1994 | Dulka et al. |
| 5,325,970 | A | 7/1994 | Dillon et al. |
| 5,400,903 | A | 3/1995 | Cooley |
| D358,483 | S | 5/1995 | Cross et al. |
| D358,935 | S | 6/1995 | Chang et al. |
| D360,075 | S | 7/1995 | Cross et al. |
| D360,978 | S | 8/1995 | Willard et al. |
| D375,629 | S | 11/1996 | Chen |
| 5,607,054 | A | 3/1997 | Hollingsworth |
| D379,267 | S | 5/1997 | Roegner |
| D380,612 | S | 7/1997 | Kelley et al. |
| D381,201 | S | 7/1997 | Miller et al. |
| D391,076 | S | 2/1998 | Test |

(Continued)

FOREIGN PATENT DOCUMENTS

| | | |
|---|---|---|
| JP | 9009832 | 1/1997 |

(Continued)

OTHER PUBLICATIONS

Brenthaven, Topload case, www.Brenthaven.com, last updated Jun. 2003.

(Continued)

*Primary Examiner*—Jacob K Ackun, Jr.
*Assistant Examiner*—Jose S Stephens, III
(74) *Attorney, Agent, or Firm*—Sheridan Ross P.C.

(57) ABSTRACT

A carrying case with an internal suspension system is provided to reduce acceleration, shock, and the vibrational loads on an electronic device, and which is selectively adjustable to accommodate electronic devices of varying sizes.

18 Claims, 5 Drawing Sheets

U.S. PATENT DOCUMENTS

| | | | | |
|---|---|---|---|---|
| D396,144 | S | | 7/1998 | Farmer |
| D399,056 | S | | 10/1998 | Tawil |
| D401,063 | S | | 11/1998 | Yamamoto et al. |
| D405,957 | S | | 2/1999 | Test |
| 5,884,768 | A | | 3/1999 | Fox |
| 5,887,777 | A | | 3/1999 | Myles et al. |
| D409,385 | S | | 5/1999 | Pearson et al. |
| 5,931,270 | A | | 8/1999 | Mitchell |
| 5,938,096 | A | | 8/1999 | Sauer et al. |
| D414,935 | S | | 10/1999 | Bould |
| D415,347 | S | | 10/1999 | Imbert |
| D417,782 | S | | 12/1999 | Tawil |
| 6,105,764 | A | * | 8/2000 | Scicluna et al. ..... 206/320 |
| 6,131,734 | A | | 10/2000 | Hollingsworth et al. |
| 6,145,661 | A | | 11/2000 | Jung |
| D434,901 | S | | 12/2000 | Eskandry |
| D435,591 | S | | 12/2000 | Wyant |
| D437,115 | S | | 2/2001 | Hillman |
| D441,533 | S | | 5/2001 | Tawil |
| 6,237,766 | B1 | | 5/2001 | Hollingsworth |
| D443,417 | S | | 6/2001 | Hillman |
| D443,983 | S | | 6/2001 | Hillman |
| D445,252 | S | | 7/2001 | Klamm |
| 6,257,407 | B1 | | 7/2001 | Truwit et al. |
| 6,267,236 | B1 | | 7/2001 | Seok |
| D447,631 | S | | 9/2001 | Hillman |
| 6,334,533 | B1 | | 1/2002 | Hollingsworth et al. |
| 6,334,534 | B1 | | 1/2002 | Hollingsworth et al. |
| 6,352,155 | B1 | | 3/2002 | Barber |
| 6,390,297 | B1 | | 5/2002 | Hollingsworth |
| D458,749 | S | | 6/2002 | Bruni et al. |
| D459,884 | S | | 7/2002 | King |
| 6,547,071 | B2 | | 4/2003 | Barber |
| D479,652 | S | | 9/2003 | Hassett |
| 6,655,528 | B2 | | 12/2003 | King |
| 6,745,897 | B2 | | 6/2004 | Barber et al. |
| D500,204 | S | | 12/2004 | Hillman |
| D500,597 | S | | 1/2005 | Hillman |
| D500,923 | S | | 1/2005 | Gonzalez et al. |
| D506,609 | S | | 6/2005 | Hillman |
| 6,977,809 | B2 | | 12/2005 | Bovino |
| 2004/0099496 | A1 | | 5/2004 | Hollingsworth |
| 2004/0134813 | A1 | * | 7/2004 | Domotor ..... 206/320 |
| 2005/0161301 | A1 | | 7/2005 | Hobermon et al. |
| 2005/0189188 | A1 | | 9/2005 | Barnes |
| 2005/0284791 | A1 | | 12/2005 | Sadow |

FOREIGN PATENT DOCUMENTS

| | | |
|---|---|---|
| JP | 10-201512 | 8/1998 |
| JP | 10-290703 | 11/1998 |
| JP | 10-290706 | 11/1998 |
| JP | 11018591 | 8/2004 |

OTHER PUBLICATIONS

Case It Catalog 2001, p. 5.
Case Logic 2001 Catalog, p. 23.
Case Logic 2002 Catalog, p. 19.
Case Logic 2002 Catalog, pp. 18 and 19.
Case Logic 2003 Catalog, pp. 10 and 11.
Case Logic Case Connect Catalog, p. 4, 1992.
J & R Music-Computer World Catalog, 2002, p. 145, Laptop Computer Bags.
Kensington, Contour Pro XBrace Carrying Case, www.kensignton.com, last updated Jun. 2003.
Lowepro 2000 Catalog, pp. 39, 57.

* cited by examiner

CASE WITH SELECTIVELY ADJUSTABLE STORAGE PORTION

FIELD OF THE INVENTION

The present invention relates to carrying cases for delicate or fragile articles such as laptop computers and other electronic equipment, and more specifically a protection system that protects stored articles from the adverse affects of acceleration, shock, and vibrational loads.

BACKGROUND OF THE INVENTION

Electronic devices such as laptop computers, DVD players, radio equipment, and non-electronic products, such as survey equipment, are very susceptible to acceleration and shock loads due to their internal circuitry and delicate componentry. As referred to herein, these devices are collectively referred to as "electronic devices." The electronic devices discussed herein are frequently hand carried and prone to damage from acceleration, shock, or vibration loading that can occur when the devices are inadvertently dropped or impacted during transportation. Previous methods of protecting electronic devices have generally employed padding materials such as foam, rubber and/or other similar compliant materials positioned within the carrying case or attache. Although padding may be somewhat protective, the majority of shock loads associated with a dropped carrying case may still be transmitted to the electronic device since padding is somewhat compressible. In addition, padding materials may be ineffective from protecting an article from acceleration or vibrational loads.

Isolation of an article generally provides improved protection to the electronic device and may include a separate padded compartment in the carrying case. These isolated storage areas are often attached to an internal wall of the carrying case and are usually made of a flexible material that acts somewhat like a spring to dampen shock and acceleration loads originating from outside of the case. Thus there is a significant need for an affordable shock resistant carrying case that can restrain and protect delicate electronic componentry from damage during impact or as a result of acceleration loading.

One prior art method of isolating an electronic device is to add a storage compartment that is partially isolated from the rest of the carrying case. The isolated compartments allow the electronic device to be slid into the case and be oriented such that a portion of the device is at or near parallel with the bottom of the case, and thus suspended above a bottom portion of the case. Generally, the compartment may be equipped with conventional foam or other padding materials to protect the electronic device. In addition, the bottom surface of the compartment may employ flexible fabrics to isolate the electronic device from loads emanating from the bottom of the case that are associated with an impact. However, no case currently exists that provides a selectively adjustable storage compartment for protecting the electronic device in a carrying case in substantially all six directions. Thus, there is a long felt but unsolved need for a carrying case that isolates fragile electronic devices, such as laptop computers, in more than one direction, and that avoids the above-mentioned deficiencies of the prior art.

SUMMARY OF THE INVENTION

Accordingly, it is one aspect of the present invention to provide a cost effective and portable carrying case that provides protection from acceleration and shock loads to an electronic device positioned within the carrying case. Thus, in one embodiment of the present invention a portable carrying case or attache is provided that employs a separate compartment for securing an electronic device and that has a suspension system that provides protection in a plurality of directions.

It is another aspect of the present invention to provide a compartment in a carrying case that is capable of providing protection to an electronic device in substantially six directions of travel. More specifically, a combination of flexible materials and conventional padding may be used to absorb loads caused by impact from substantially any direction, thus providing more protection than traditional cases that depend solely on padding for protection.

It is yet another aspect of the present invention to provide a lightweight, cost effective storage case. A shock absorbent or loads resistant case can be made of any number or combination of materials which dictate the weight of the finished product. A substantially indestructible and protective shock absorbent or load resistant case would generally not be feasible to construct because of the significant weight and cost. Thus, materials that are preferably used to protect and isolate electronic devices are generally light, and more specifically, materials such as nylon, Teflon®, elastic fiber, etc. are used. By altering the way these materials are used with each other, and with the addition of padding, an electronic device can be protected in substantially six directions of travel.

It is yet another aspect of the present invention that the compartment that secures the electronic device be expandible. By using certain flexible and expandable materials, an added advantage of expandability emerges. Some cases that do not use flexible materials, or limit their use, commonly have carrying compartments of fixed volumes. A user of a case with a fixed volume may be forced to buy a new case when purchasing a new electronic device. Electronic devices vary in size and shape, and a compartment that is compliant with different electronic devices is of great utility to a user.

It is still yet another aspect of the present invention to provide a case that includes a selectively adjustable storage compartment. More specifically, embodiments of the present invention employ a compartment that includes an adjustable internal panel in combination with adjustable side members that secure the electronic device. In addition, cushioned ribs may be employed that engage the electronic device. The adjustable side members in embodiments of the present include a selective fastening member for engagement to the internal panel. Thus a storage compartment is defined by the adjustable panel, the rear panel of the computer case with perhaps at least one cushioned rib protruding therefrom, and two adjustable side members. By selectively adjusting the location of interconnection of the adjustable side members to the adjustable internal panel, a user can selectively expand and contract the storage compartment to accommodate various sized electronic devices. More specifically, in one embodiment of the internal compartment is preferably adjustable to alter the horizontal dimension, vertical dimension, and depth of the compartment. Thus, the internal storage compartment can be selectively adjusted to secure a variety of different notebook computers with varying widths, heights and thicknesses. In addition, the adjustable internal panel may terminate and be hingedly interconnected to an inside corner of the computer case thereby providing some protection to the device against impacts, as described above. One skilled in the art should appreciate that further protection methods may be employed in conjunction with the adjustable storage compartment as primarily described herein without departing from the scope of the invention. For example. Internal gussets or suspension systems which may be interconnected to internal or external materials and framework may also be utilized.

It is still a further aspect of the present invention that the carrying case and carrying compartment may be designed from inexpensive materials that are well-known in the art. These include nylon, rubber, plastics and other similar materials which are generally flexible and lightweight as opposed to more rigid.

Thus, in one embodiment of the present invention a carrying case with an internal suspension system adapted for supporting and protecting an electronic device, is provided, comprising:

an enclosure defined by a front panel, a rear panel, a bottom panel, a top panel and opposing side panels;

a selective opening means interconnected to at least one of said top panel, said front panel and said rear panel to allow access to an internal portion of said enclosure;

a support platform operably interconnected to an internal portion of said enclosure and elevated above said bottom panel, said support panel adapted to support an electronics device; and an adjustable lateral restraint means interconnected to an internal surface of said enclosure which is adapted to engage at least two opposing edges of said electronic device to substantially impede lateral movement and within said storage case.

It is a further object of the present invention to provide a method of storing an electronic device in a selectively adjustable case including:

a portable storage enclosure with at least one opening is provided;

inserting an electronics device into a cradle formed by a suspension platform interconnected to an interior of the carrying case, wherein the electronics device is supported above a bottom panel of the carrying case; and selectively adjusting a first lateral restraint member and a second lateral resistant member to enclose the electronics device and secure the restraint members to the support panel, wherein the electronics device is substantially impeded from inadvertent movement.

The summary of the invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. as provided herein. Additional aspects of the present invention will become more readily apparent in the detailed description, particularly when taken together with the drawings.

Figure 1:
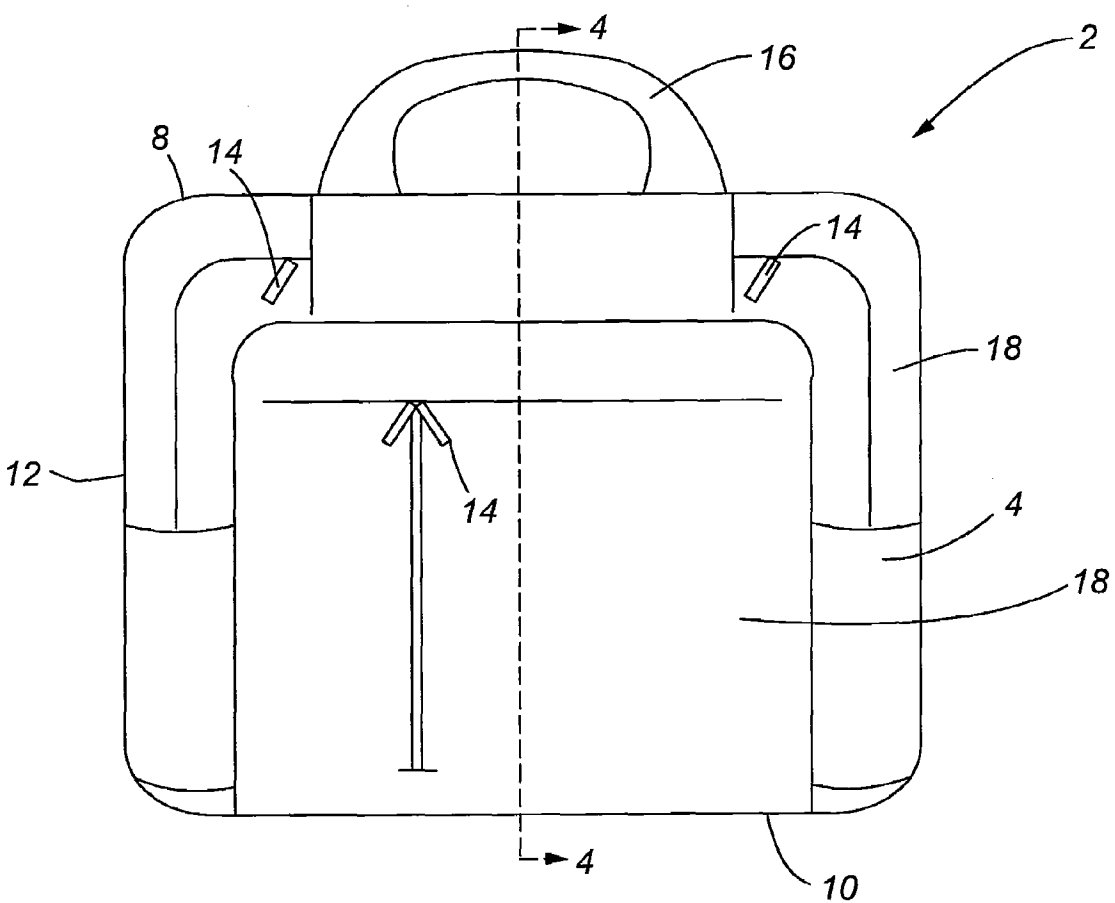
FIG. 1 is a front elevation view of one embodiment of the present invention.

To assist in the understanding of the present invention the following list of components and associated numbering found in the drawings is provided herein:

| # | Component |
|---|---|
| 2 | Electronic storage case |
| 4 | Front panel |
| 6 | Rear panel |
| 8 | Top panel |
| 10 | Bottom panel |
| 12 | Side panel |
| 14 | Zipper pull |
| 16 | Handle |
| 18 | Auxiliary storage compartment |
| 20 | Storage compartment |
| 22 | Cushioned rib |
| 24 | Adjustable support panel |
| 26 | First restraint member |
| 28 | Second restraint member |
| 30 | First fastening member |
| 32 | Second fastening member |
| 34 | Storage compartment lower surface |
| 36 | Electronic device |
| 38 | Gusset |
| 40 | Strap ring |
| 42 | Padding |

DETAILED DESCRIPTION

Referring now to FIG. 1, a front elevation view of one embodiment of the present invention is provided herein. More specifically, an electronic device storage case 2 is provided that generally comprises a front panel 4, a rear panel 6, a top panel 8, a bottom panel 10 and opposing side panels 12 positioned between the top panel 8 and the bottom panel 10. Alternatively, the top panel 8 may be removed and the case 2 interconnected along an upper edge of the front panel 4 and rear panel 6. Although generally designed to carry a notebook computer, the electronic device storage case 2 may be used to retain and safely store any type of electronic device that may be fragile and prone to breakage. The electronic device storage case 2 shown in FIG. 1 generally includes one or more openings that allow access to the electronic storage case and insertion and removal of the electronic device. The storage compartment may be selectively accessed with the use of one or more zippers 14, buckles, or other types of opening mechanisms commonly known in the art. Generally, the openings are included in the top panel 8, but openings may also be positioned in the front panel 4, rear panel 6, or within one of the side panels 12. The electronic storage case 2 may also include a handle 16 and at least one auxiliary storage compartment 18. The auxiliary storage compartment 18 of one embodiment of the present invention may secure items like address books, compact discs, sunglasses, phones, PDAs, and other similar commonly used items.

Figure 2:
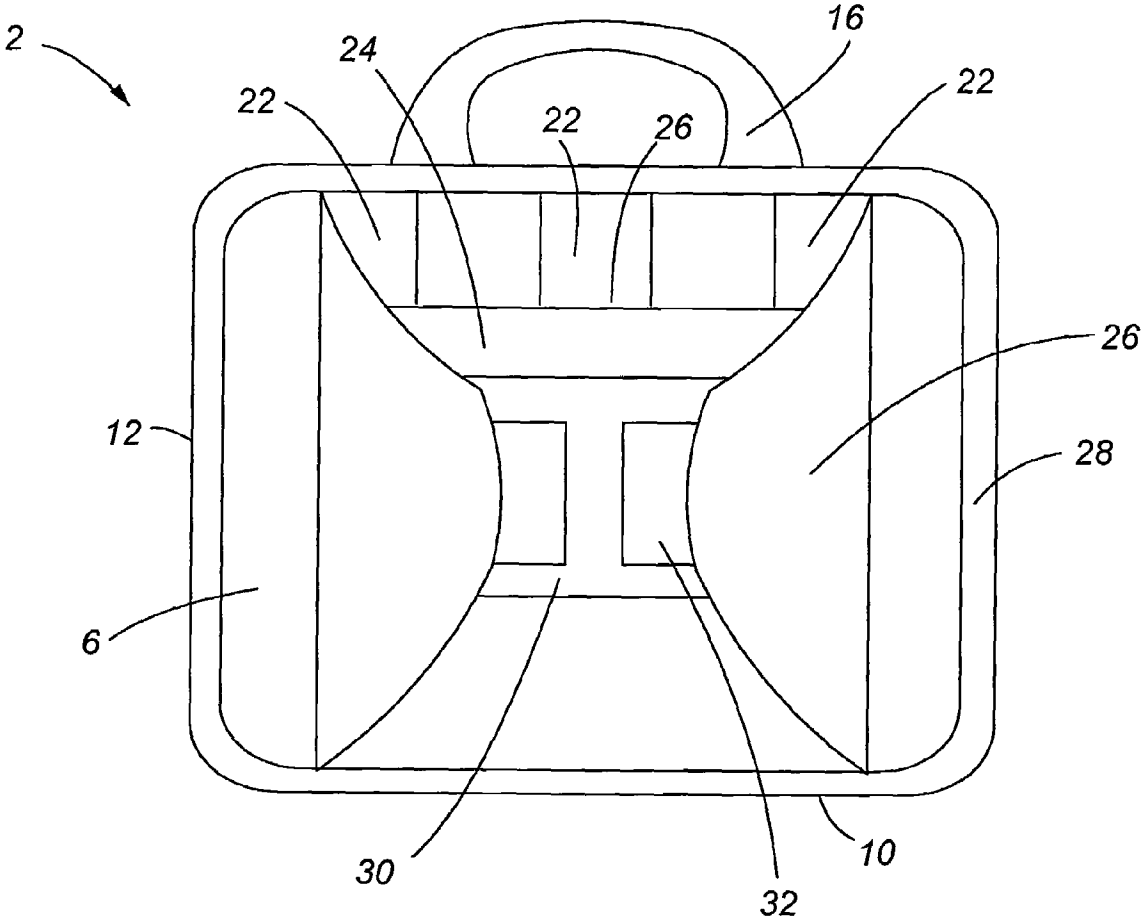
FIG. 2 is a front elevation view of the embodiment shown in FIG. 1 with the front panel removed for clarity, and identifying internal components of an internal suspension system.
Figure 3:
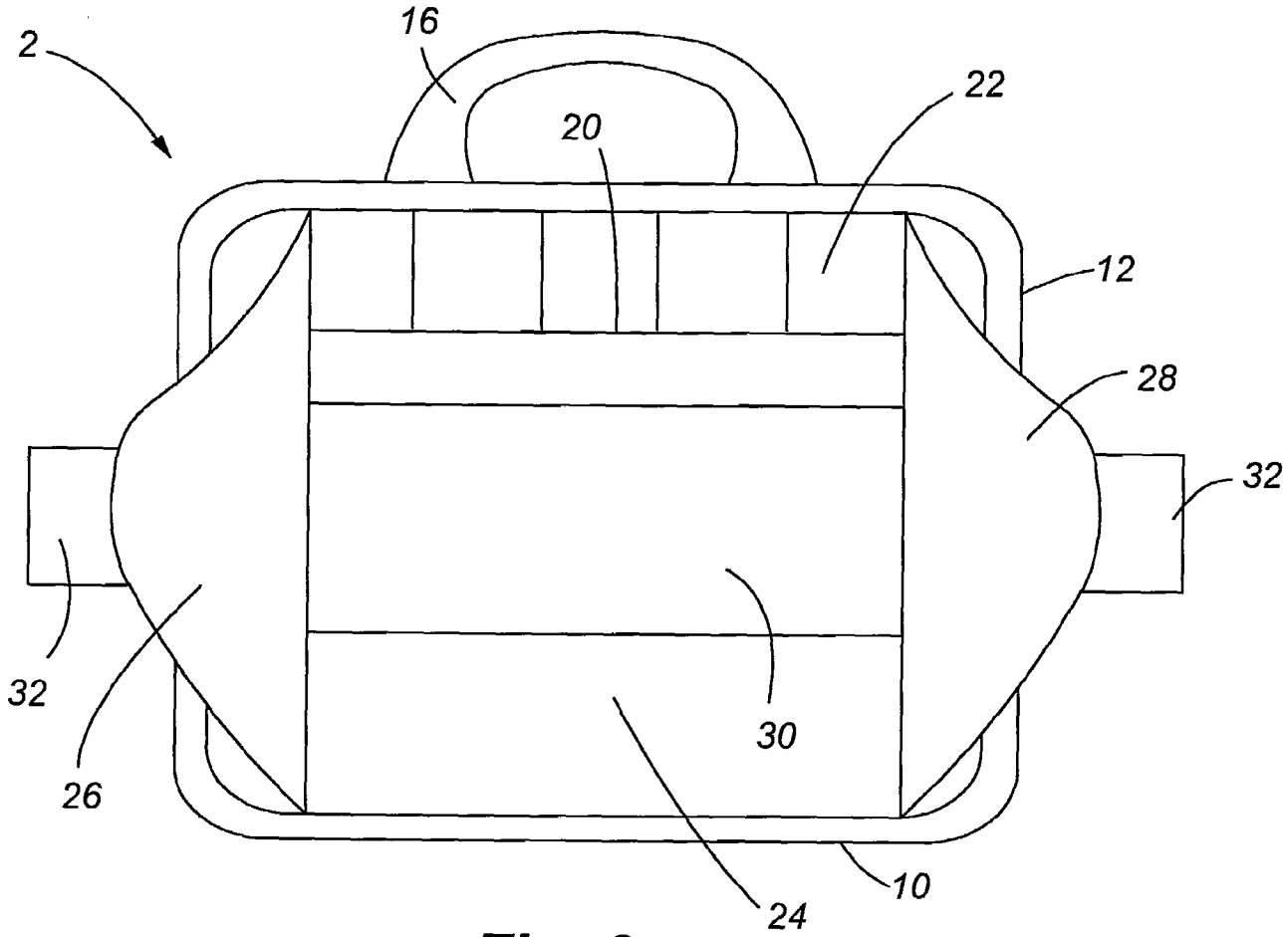
FIG. 3 is a front elevation view of the embodiment shown in FIG. 1 with the front panel removed for clarity and showing adjustable side members opened.

Referring now to FIGS. 2 and 3, a front elevation view of one embodiment with the front panel omitted for clarity is provided herein. More specifically, a storage compartment 20 for receipt of an electronic device is provided. The storage compartment 20 is defined by the rear panel 6 that may include a plurality of cushioned ribs 22 emanating therefrom, an internal support panel 24, and two adjustable restraint members 26 and 28. The electronic device is thus supported on one surface by the adjustable internal support panel 24, or another surface by the cushioned ribs 22, and its left and right sides by the adjustable restraint members 26 and 28 respectively. A portion of the electronic device is also supported by a lower surface of the storage compartment 20 that also provides some impact isolation since it is spaced from the bottom panel 10 of the electronic storage case 2. The electronic storage case 2 may also include padding 42 in a variety of locations to provide added protection. The internal support panel 24 in one embodiment includes a first fastening member 30 for selective interconnection to a second fastening member 32 interconnected to both adjustable side members 26 and 28. These fastening members may comprise hook and loop fasteners, such as Velcro® but other fasteners known in the art such as snaps, buckles or latches, etc. may be employed without departing from the scope of the invention. In order to increase at least one dimension of the storage area, a user selectively disconnects the fastening members, transitions the adjustable support panel 24 towards the rear panel 6 of the case 2 to make the storage compartment 20 thinner or transition the internal support panel 24 away from the rear panel 6 to make the storage compartment 20 thicker and re-interconnect the fastening members. The first adjustable restraint member 26 and second adjustable restraint member 28 provide a means for securing the internal support panel 24 and substantially prevent the movement of the stored device in a direction transverse to the thickness of the electronic storage case 2. Thus the dimension of storage area may be selectively adjusted to assure that the electronic device is securely retained to avoid unnecessary movement and to provide the flexibility to store electronic devices with different dimensions.

Figure 4:
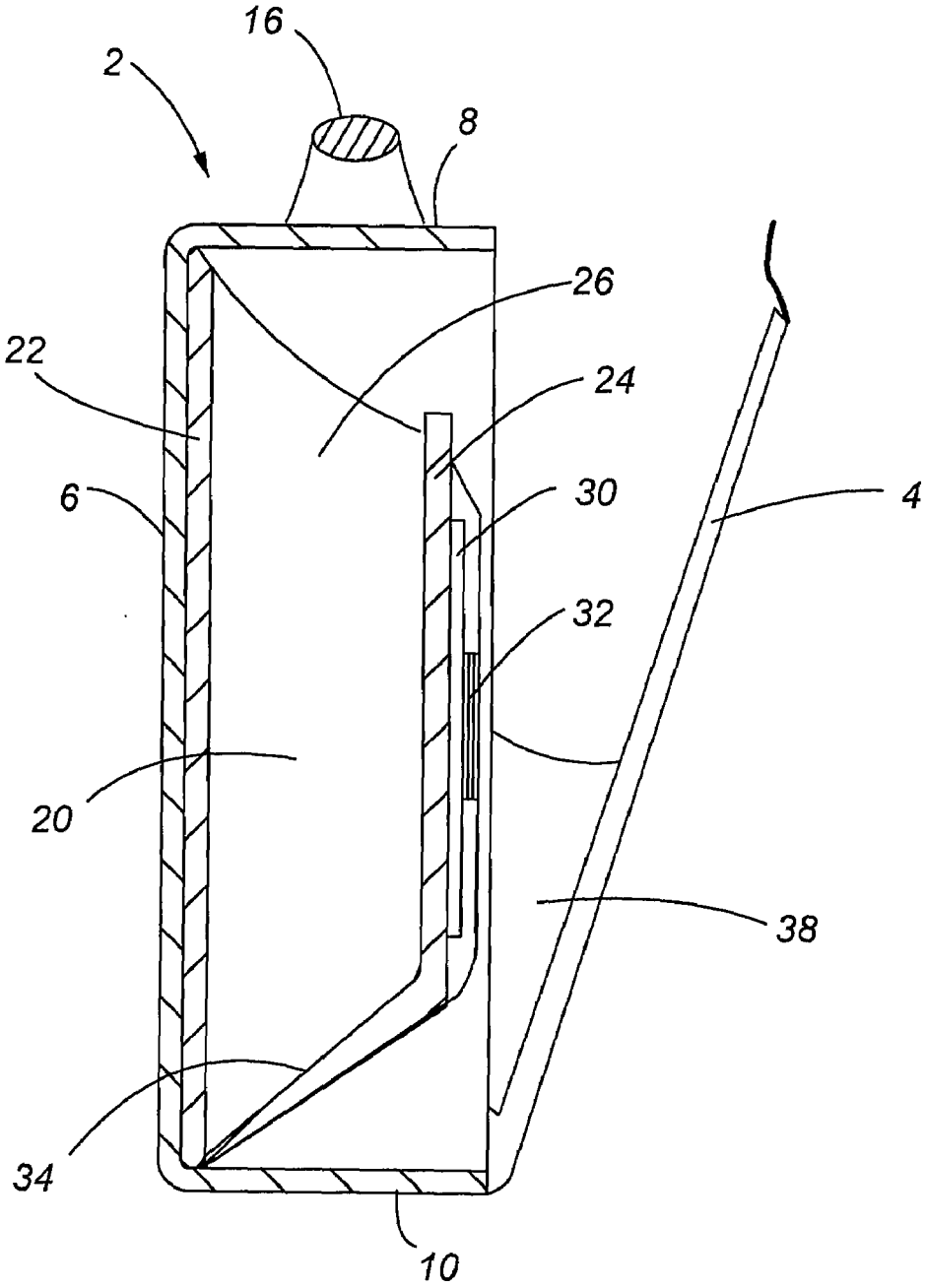
FIG. 4 is a left partial cross-sectional view of the invention shown in FIG. 1 with a portion of the front panel removed for clarity.
Figure 5:
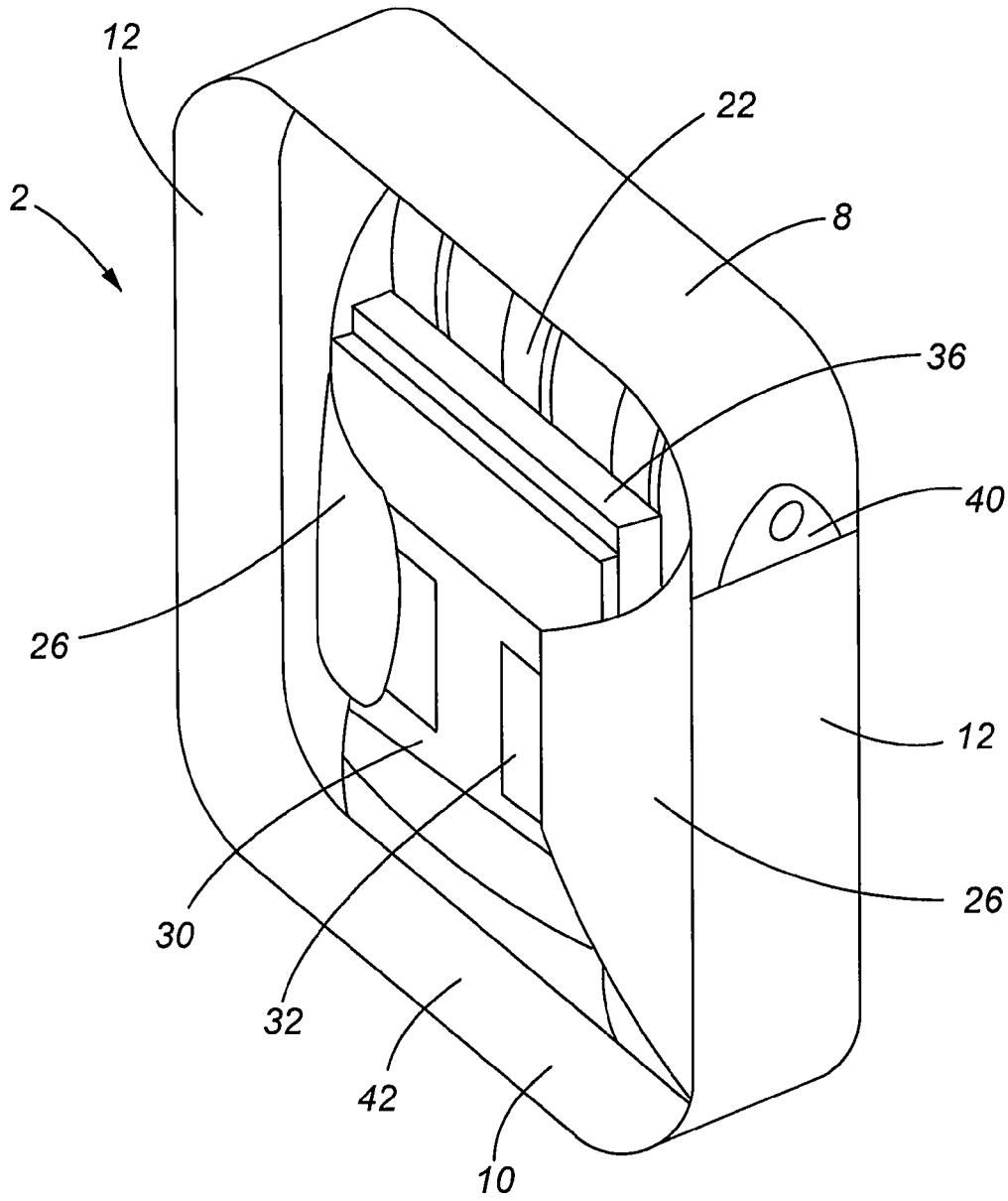
FIG. 5 is a front perspective view of the embodiment shown in FIG. 1 with the front panel removed to identify the internal components.

Referring now to FIGS. 4 and 5, cross sectional and perspective views of one embodiment of the present invention are shown. More specifically, additional detail regarding the storage compartment is provided within the electronic storage case 2 will be appreciated. The storage compartment 20 is defined by cushioned ribs 22, the internal support panel 24, the adjustable restraint members 26 and 28, and a storage compartment lower surface 34. This lower surface provides a space between the storage compartment 20 and the bottom panel 10 of the electronic storage case 2 thereby at least partially isolating a stored electronic device 36 from the bottom panel 10 of the case to provide some shock isolation. Preferably there is a gap or spacing of at least about 1 inch, and preferably 2-3 inches to prevent the electronic device from impacting a solid surface if the storage case 2 is inadvertently dropped. In addition, the adjustable support panel 24 may be hingedly interconnected to a corner defined by the rear panel 6 and the bottom panel 10 of the electronic storage case 2. One skilled in the art will appreciate that other interconnection methods can be employed to further isolate the electronic device 36 without departing from the scope of the invention. Further, the front panel 4 of the case may be interconnected to the side panels of the case 2 by gussets 38. Again, one skilled in the art will appreciate that these gussets 38 may be omitted to allow the front panel 4 to open to a greater extent thereby providing greater access to the interior or the case 2. Although the handle 8 is primarily shown and described herein, other methods of securing the electronic storage case 2 to an individual, such as a strap (not shown) may be included that is selectively interconnectable to the electronic storage case 2 via a strap ring 40.

While various embodiments of the present invention have been described in detail, it is apparent that modifications and variations of those embodiments will occur to those skilled in the art. However, it is to be expressly understood that such modifications are within the scope and spirit of the present invention.

What is claimed is:

1. A storage case for an electronics device with an internal shock suspension system, comprising:

an enclosure defined by a front panel, a rear panel, a bottom panel, a top panel and opposing side panels;

a selective opening means interconnected to at least one of said top panel, said front panel and said rear panel to allow access to an internal portion of said enclosure;

a support platform that is adapted to support an electronic device hingedly interconnected to a corner of said storage case defined by an inner surface of said rear panel and an inner surface of said bottom panel, said support platform being elevated above said inner surface of said bottom panel;

a cushioned rib interconnected to said internal surface of said rear panel;

an internal support panel interconnected to said support platform and spaced from said cushioned rib;

a first lateral restraint member hingedly interconnected to said inner surface of said rear panel on a first edge and selectively interconnected to said internal support panel on a second end;

a second lateral restraint member hingedly interconnected to said inner surface of said rear panel on a first edge and selectively interconnected to said internal support panel on a second end; and wherein the electronic device is stored exclusively between said cushioned rib, said internal support panel, said first lateral restraint member and said second lateral restraint member.

2. The storage case of claim 1, wherein said first and second lateral restraint members allow selective alteration of the storage volumes between said cushioned rib and said internal support panel.

3. The storage case of claim 1, wherein said cushioned rib is comprised of a compressible material.

4. The storage case of claim 1, wherein said selective opening means comprises at least one of a zipper, a hook and loop material and a strap and buckle.

5. The storage case of claim 2, further comprising a hook and loop material positioned on a portion of said internal support panel which is adapted to engage a hook and loop material positioned on said first and second lateral restraint members.

6. The storage case of claim 1, further comprising at least one external pocket adapted for storing accessory items.

7. A carrying case comprising at least a front panel, rear panel, and a bottom panel, the improvement comprising an adjustable internal suspension system adapted for supporting an electronic device, comprising:

a) a support panel having a first end interconnected to an inner surface of at least one of said front panel and said rear panel above said bottom panel and a second end positioned proximate to a selective opening means of the carrying case, said support panel further comprising a hook and loop material positioned between said first end and said second end;

b) a first restraint member and a second restraint member each hingedly interconnected on a first end to an inner surface of at least one of said front panel and said rear panel and selectively interconnected to said support panel on a second end to define a compartment adapted to receive the electronics device, wherein said first restraint member and said second restraint member selectively interconnect to said support panel such that said second end of said support panel is selectively adjustable;

c) a hook and loop material positioned proximate to said second end of said first and second restraint members which are adapted for removable interconnection to said hook and loop material interconnected to said support panel, wherein said first and second restraint members are selectively adjustable in combination with the support panel to secure the electronics device within the carrying case.

8. The carrying case of claim 7, further comprising a handle interconnected to an exterior of said carrying case.

9. The carrying case of claim 7, wherein said support panel is comprised of at least one of an elastic material, a rubber material, a foam material and a nylon material.

10. The carrying case of claim 7, wherein said carrying case is at least one of an attache, a piece of luggage, a purse, a backpack and a suitcase.

11. The carrying case of claim 7, wherein said support panel is at least partially comprised of a compressible material to provide additional protection to the electronic device.

12. The carrying case of claim 7, wherein said support panel further comprises a retention device positioned proximate to said second end which is adapted for interconnection to at least one of said front panel and said rear panel to substantially prevent said electronic device from vertical travel.

13. The carrying case of claim 7, wherein said selective opening means comprises at least one of a hook and loop material, a zipper and a strap and buckle.

14. A carrying case with an internal suspension system adapted to store an electronic device, comprising:

a front panel, a rear panel, a top panel, a bottom panel and opposing side panels;

an opening means interconnected to at least one of said front panel, said rear panel, said top panel and said opposing side panels;

an internal support panel interconnected to an interior of said carrying case, wherein a lowermost portion of said internal support panel is positioned above said bottom panel;

a first restraint panel and a second restraint panel hingedly interconnected to an internal surface of said carrying case and selectively interconnected to said internal support panel to form a sleeve for retaining said electronic device such that a stored electronics device does not contact the bottom panel or opposing side panels; and a means for selectively interconnecting said internal support panel to said first restraint panel and said second restraint panel to substantially enclose said electronic device and impede lateral movement.

15. The carrying case of claim 14, wherein said means for selective interconnection comprises a hook and loop material positioned on each of said first restraint panel, said second restraint panel and said internal support panel.

16. The carrying case of claim 14, wherein said internal support panel is suspended above an internal surface of said bottom panel a distance of at least about two inches.

17. The carrying case of claim 14, wherein said opening means comprises at least one of a zipper, a hook and loop material and a strap and buckle.

18. The carrying case of claim 14, wherein at least one of said internal support panel, said first restraint panel and said second restraint panel are comprised of a compressible material.

* * * * *